US006370690B1

(12) United States Patent
Neal

(10) Patent No.: US 6,370,690 B1
(45) Date of Patent: Apr. 16, 2002

(54) LIGHTWEIGHT FRAGMENTATION RESISTANT BODY ARMOR CONFIGURATION

(76) Inventor: Murray L. Neal, 681 E. Brighton La., Fresno, CA (US) 93720

( * ) Notice: Subject to any disclaimer, the term of this patent is extended or adjusted under 35 U.S.C. 154(b) by 0 days.

(21) Appl. No.: 09/812,616

(22) Filed: Mar. 19, 2001

(51) Int. Cl.[7] ..... F41H 1/02
(52) U.S. Cl. ..... 2/2.5; 89/36.02; 428/911
(58) Field of Search ..... 2/2.5; 89/36.01, 89/36.02; 428/293.4, 325, 340, 911

(56) References Cited

U.S. PATENT DOCUMENTS 4,181,768 A * 1/1980 Severin ..... 428/252
4,457,985 A * 7/1984 Harpell et al. ..... 428/911
5,738,925 A * 4/1998 Chaput ..... 2/2.5
5,824,940 A * 10/1998 Chediak et al. ..... 89/36.05
6,035,438 A * 3/2000 Neal et al. ..... 2/2.5

* cited by examiner

*Primary Examiner*—Gloria M. Hale
*Assistant Examiner*—Tejash Patel
(74) *Attorney, Agent, or Firm*—Blakely, Sokoloff, Taylor & Zafman

(57) ABSTRACT

A method and apparatus for defeating high velocity fragmentation and/or shrapnel projectiles. A plurality of discs in an imbricated pattern are backed by alternating layers of high tensile strength ballistic material. The alternating nature of the layout of these ballistic materials combined with the discs tends to deform and turn striking fragmentation projectiles. Deformation of the fragments causes them to be easier to slow and stop. Turning the fragments allows a greater area of the armor material to engage the fragments.

30 Claims, 3 Drawing Sheets

LIGHTWEIGHT FRAGMENTATION RESISTANT BODY ARMOR CONFIGURATION

BACKGROUND OF THE INVENTION

1. Field of the Invention

The invention relates to protective wear. More specifically the invention relates to flexible body armor designed to defeat high velocity fragmentation projectiles.

2. Background

In recent years fragment resistant materials formed from high tensile strength fibers such as aramid fibers or polyethylene fibers, have gone into common use in the field. Unfortunately, soft body armor, even with these advanced materials, have proven insufficient to thwart armor piercing pistol ammunition, sharp thrusting instruments, and circular penetrators, all which are now in common use.

To address this problem, various hard metal plating systems have been developed. One attempt to shield soft targets from fragmentation involves the use of approximately 1"×12" large hard plates attached to a vest type garment. The difficulty with this approach is that the vest is bulky, difficult to move around in and heavy. Another attempt is using smaller rigid plates aligned with metal and/or ceramic overlapping edges. However, these vests are cumbersome as well and are not sufficiently flexible.

Another such solution employs a number of titanium disks one inch in diameter and having uniform thickness in the range of 0.032 to 0.050 inches in thickness laid out in overlapping rows such that the interior of a row, a disk overlaps its predecessor in the row and is overlapped by its successor in the row. Subsequent rows overlap the predecessor and are overlapped their successor. The coin layout is then attached to a substrate such as an adhesive impregnated aramid fabric. A second layer of adhesive impregnated aramid fabric may be used to envelop the "panel" formed by the coins. This enveloped panel can be attached to conventional soft body armor over vital organ area of the torso. It provides good flexibility and is thin enough to conceal. A third solution employs a number of high hardness plates often of a hexagonal shape. Such plates typically have a uniform thickness in the range of 0.032 to 0.050 inches and are tiled over the area to be protected.

Fragmentation artillery rounds contain an explosive charge designed to distribute fragmentation and shrapnel which are metal projectiles arrayed around the explosive charge contained in a metal encasement wall that on detonation of the explosive charge fragments into irregular shaped hot high velocity projectiles. After detonation, the artillery projectile encasement wall is torn to shreds and becomes fragments. Fragmentation and shrapnel wounds are caused when these hot jagged pieces of steel are impelled away from the sight of the explosion and by virtue of their velocity and mass tear into and destroy soft targets, for example, people. The above mentioned overlapping of coins have been shown to spread the force effectively of a pistol round protecting a wearer from handgun injuries. However, these vests still do not fully resist penetration enough to protect the wearer from high velocity and mass fragmentation effects of a shrapnel artillery round.

The damage done by fragmentation is usually modeled using a bullet type sabot fragment simulator. One such simulator is a right round circular penetrator. These are solid steel projectiles with blunt ends about 0.217" in diameter and 0.220" in length. Another simulator is the stanag 2920

NATO standard which has a chisel point, weighs about 17 grain, has a velocity of 650 meters per second, and is 0.217" in diameter and 0.260" in length. One level of fragmentation protection provided by armor has been quantified in U. S. military standard (mil std) 662E. A "F6" fragmentation level of protection, as defined by mil std 662E, will stop a stanag 2920 projectile traveling at 650 meters per second generating at least 20.53 foot pounds of energy. This is the highest body armor fragmentation velocity standard in use.

The damage done by fragmentation and/or shrapnel can be modeled using armor piercing bullets as well. The results from armor piercing bullet emulations can provide an indication of general fragmentation stopping ability of a vest. An examination of the encasement wall of the artillery round properties (i.e. type of steel, thickness of encasement wall, diameter of artillery round), along with characterization of the explosive charge (i.e. composition and amount of powder) permits deductions about fragment size generated by a detonation, for example mass and volume of fragments, from a shrapnel shell. Also the above analysis gives a good indication of fragment velocity at the location of the detonation. Analysis of intended burst altitudes of the shell along with mechanics allows an estimation of fragment velocity at impact of a typical target. Armor piercing bullets are used, because they have not been designed, like for example hollow point bullets, to deform on impact and therefore more closely resemble fragments on impact.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION OF THE INVENTION

A method and apparatus for protecting personnel from fragmentation and/or shrapnel injuries is disclosed. In the following description, for purposes of explanation, numerous specific details are set forth to provide a through understanding of the invention. It will be apparent, however, to one of ordinary skill in the art that the invention may be practiced without some of these specific details. The following description and accompanying drawings provide examples for the purpose of illustration. However, these examples should not be construed in a limiting sense as they are merely intended to provide examples of the invention rather than to provide an exhaustive list of all possible implementations of the invention.

Reference will now be made to drawings. In the following drawings, like structures are provided with like reference designations. In order to show the structures of the invention more clearly, the drawings included herein are diagrammatic representations of the indicated structures. Thus, the actual appearance of the fabricated structures, for example in a photograph, may appear different while still incorporating the essential structures of the invention. Moreover, the drawings show only the structures necessary to understand the invention. Additional structures known in the art have not been included to maintain the clarity of the drawings.

Figure 1A:
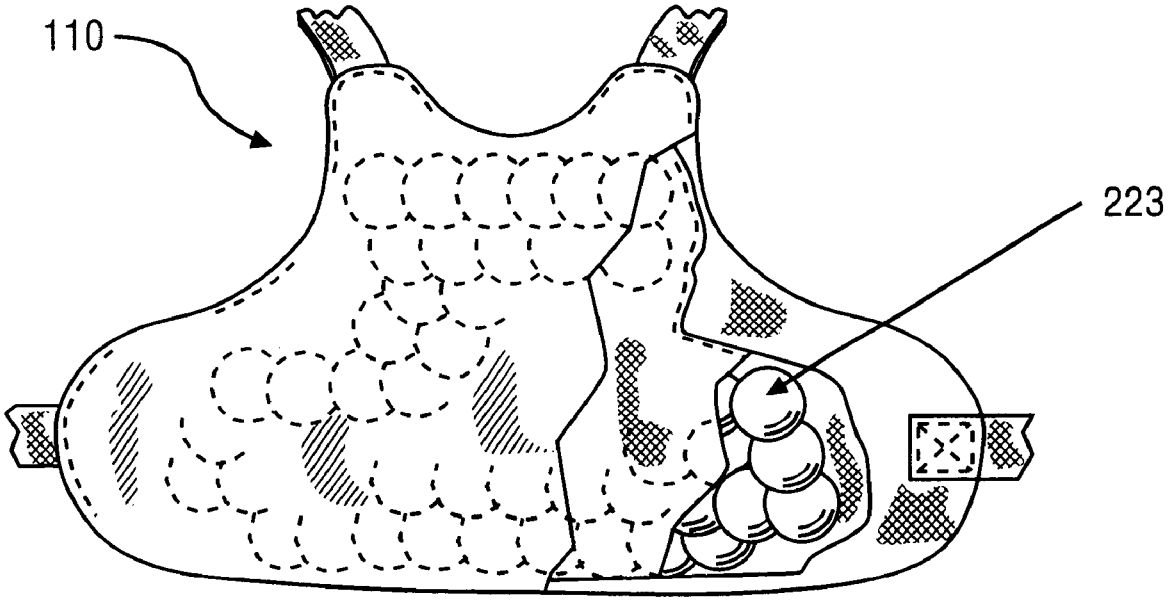
FIG. 1*a* is a cut away view of one embodiment of the drawing of the body armor.

FIG. 1*a* is the cut away frontal view of one embodiment of the suit of fragmentation armor. Disks 223 are arrayed in an imbricated pattern to cover vital areas where the body armor is worn. Unlike the typical 10" by 12" rigid plates of prior art the imbricated pattern conforms around body contours and therefore is considerably more comfortable and readily concealable. Each disk 223 is formed of a high hardness material.

The overlap of the imbricated placement pattern has been found to effectively spread the force of the high velocity projectile hit to adjacent disks, thereby preventing penetration and backside deformation. Additionally, because of the slight tilt of each overlapping disk in the imbricated pattern, a perpendicular hit is less likely and some of the energy, of a surface strike, will be absorbed into deflection of other adjacent disks. In one embodiment titanium disks one inch in diameter and having uniform thickness in the range of 0.032 to 0.050 inches in thickness are used to form the imbricated pattern. In an alternative embodiment disks of metal or ceramic having a discus shape may be employed.

Figure 1B:
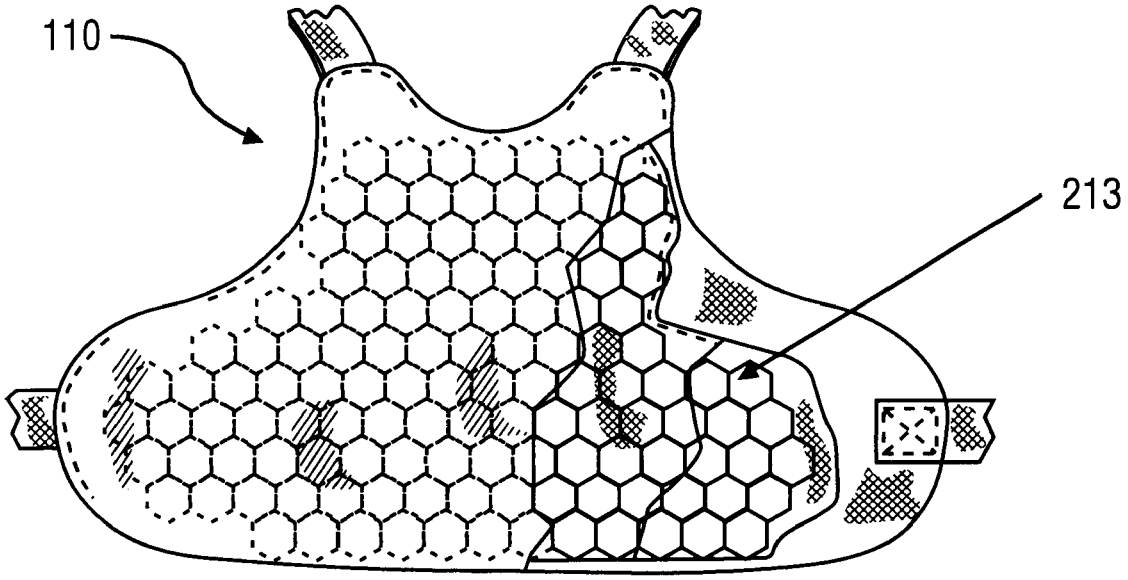
FIG. 1*b* is a cut away view of another embodiment of the drawing of the body armor.

FIG. 1*b* is a cut away frontal view of another embodiment of the suit of fragmentation armor. Plates 213 are arranged in a single layer with each edge of a plate touch an edge of another plate, but not overlapping. These small plates allow the armor to flex at their intersection and to conform around body contours making the vest more comfortable and readily concealable.

Figure 2:
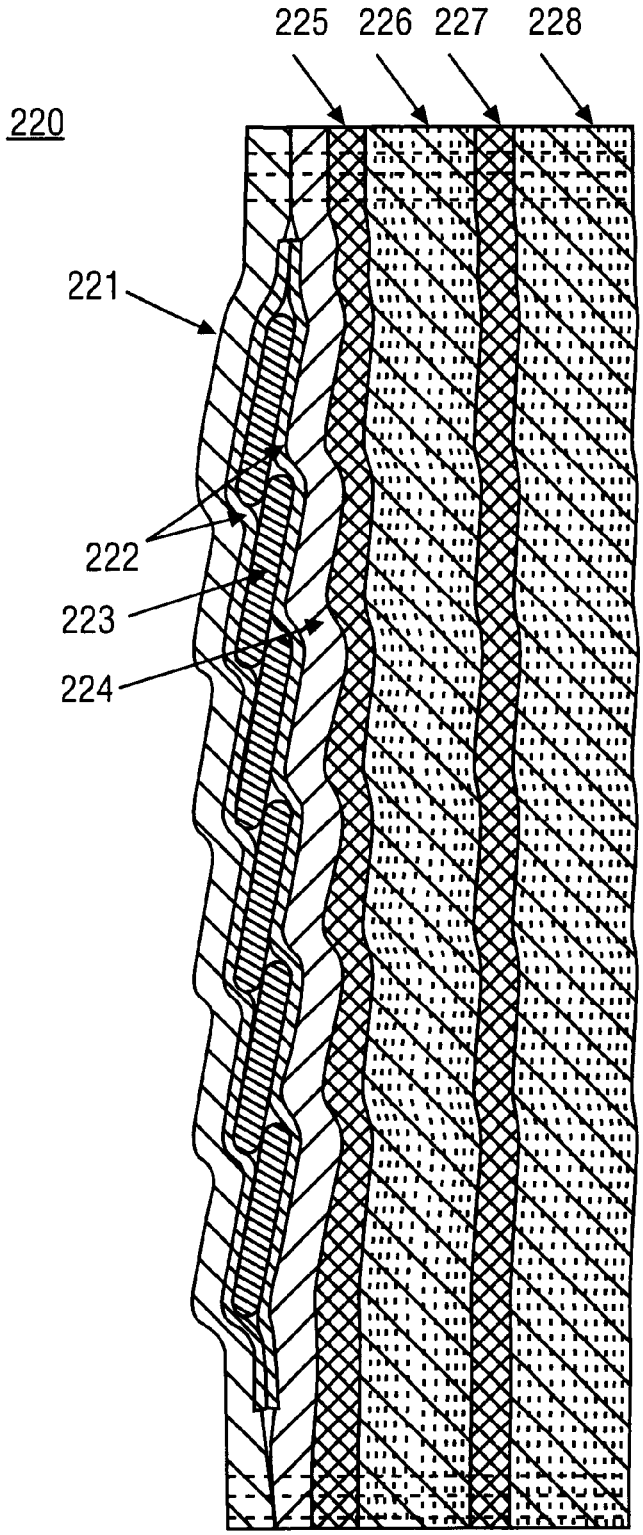
FIG. 2 is a side cut away cross sectional view of one embodiment of the body armor.

FIG. 2 is a side cut away cross sectional view of one embodiment of the armor. FIG. 2 shows a view of one embodiment of the fragmentation armor. Some high tensile strength ballistic resistant materials will tend to deform and slow down a projectile while other types of high tensile strength ballistic materials tend to grab and turn a ballistic projectile. Grabbing and turning the ballistic projectile will introduce yaw into the path of the ballistic projectile. Yaw is a pivoting motion perpendicular to the direction the projectile is traveling. A fragment projectile undergoing yaw will either roll onto its side or tumble. As the fragment projectile rolls or tumbles more surface area is exposed to be caught by the vest.

The tensile strength of a ballistic fabric is a leading indicator of that fabric's ability to induce yaw into the path of a projectile. A higher tensile strength gives the fabric a better ability to grab the projectile before yield than a lower tensile strength fabric. The fabric's grabbing of the projectile before yielding is what induces yaw into the path of the projectile. The tensile strength of a thread of ballistic material can be increased by increasing the denier of the thread. Thus a 1500 denier material will have a higher tensile strength than a 800 denier material of an identical fiber.

The behavior of high tensile strength ballistic resistant material is the result of the materials tensile strength, elongation to failure and pick count. When struck by a ballistic projectile a high tensile strength ballistic material with a high pick count and a low elongation to failure will tend to grab at a projectile and turn it to induce yaw, but will not cause much deformation or slowing of the projectile. A ballistic material with a higher elongation to failure will tend to hang on to the projectile relatively longer deforming the projectile and slowing it down before yielding and allowing the projectile to pass through the material. As such it should be noted that similar materials with differing pick count and deniers effectively make different fabrics. While materials with similar deniers and similar pick counts might be thought to have identical stopping power and abilities, a varying elongation to failure could make these materials completely dissimilar. Thus, it is not always possible to base exact ratios of equal projectile stopping ability based on only denier and pick counts.

This disclosure discusses various lay-ups of Kevlar® KM2 1500 and Twaron® 840 denier fabrics. One of ordinary skill in the art would however recognize, that with adequate notice taken to denier, pick count and elongation to failure various materials can be substituted for the Kevlar® KM2 1500 and Twaron® 840 material mentioned above. Such substitutions can be, but are not limited to para aramids such as PBO Zylon®, various denier Kevlar® KM2 derivative materials such as 800 denier, 600 denier, or 400 denier material and Kevlar® 129 400 denier material.

The fragmentation vest is a combination of layers designed to ultimately cause deformation to a fragment and to induce yaw into the fragment. The first layer 221 of the fragmentation vest, as shown in FIG. 2 is a high tensile strength ballistic fiber. In one embodiment the first layer is one ply of Twaron® 840 denier aramid fabric with a pick count of 27×27. Twaron® at this denier and pick count has an areal density of 0.67 oz. per square foot. Twaron® is available from Akzo Nobel Twaron, Inc. of Arnhem of the Netherlands. In one embodiment, this high tensile strength ballistic fabric has adhered to it an imbricated pattern of high hardness disks 223 as described above in connection with FIG. 1*a*. The adhesive 222 used to adhere the disks in the imbricated pattern to the ballistic fabric is a highly aggressive adhesive such as certain petroleum based low modulus adhesives available from Bondtex Inc., Los Angeles, Calif. The imbricated disks are then sandwiched between the first layer of ballistic grade fabric and a second layer of ballistic grade fabric 224 by this adhesive. This combination of the two layers of ballistic grade fabric 221 and 224, and the disks 223 in the imbricated disk pattern and the adhesive layers 222 serve to slow and deform the high velocity fragment projectile. In one embodiment the second layer of ballistic grade fabric as also one ply of Twaron® 840 denier with a pick count of 27×27. Twaron® has been found effective in slowing and deforming projectiles.

Third layer 225 of high tensile strength ballistic grade material fabric connected to the above arrangement tends to grab a passing projectile and induce yaw into the trajectory of the fragment. Fragments traveling through this layer will tend to tumble on exit from the layer. In one embodiment the third layer is one ply of Kevlar® KM2 1500 denier aramid fabric with a pick count of 35×35. Such fabric has an areal density of 1.53 oz./sq. ft. Kevlar® is available from E. I. du Pont de Nemours and Company of Wilmington, Del. A forth layer 226 of ballistic grade fabric is coupled adjacent to the third layer. The fourth layer is selected to have a tendency to deform and slow down a projectile. In one embodiment this fourth layer 226 is seventeen plys of Twaron® with the same characteristics as the first layer. Fabric layer 226 acts on the fragment projectile after it has been deformed and slowed by the imbricated disk pattern and tugged at to induce yaw by the high tensile strength ballistic fabric layer 225. A fifth layer 227 a high tensile strength ballistic grade fabric is coupled adjacent to the fourth layer. Like third layer 225, the fifth layer is intended to tug at the projectile and induce additional yaw into the path of the projectile. In one embodiment the layer may be identical to the third layer. The sixth layer 228 of ballistic grade fabric is again designed to deform and slow down the fragment after it has passed through prior layers of the vest. In one embodiment, the sixth layer is identical to the fourth layer.

Low denier, low pick count fabric, below about 850 denier and 27×27 ends per inch with high elongation to failure, has been found to effectively deform fragments better than high denier high pick count fabrics with less elongation to failures. These low denier, low pick count fabrics have the added benefit of lighter weight. High tensile strength aramid ballistic fabric with a denier of about 850 is available now. Similar fabric with a denier of about 600 is now becoming available, and in the near future, denier counts of 500 and 400 will be available. These lower denier fabrics will be even lighter than the 850 denier fabric. It is anticipated that these even lower denier fabrics will have greater deformation power than the currently available 850 denier fabric in comparison with the high denier fabric.

In one embodiment, from strike face toward the wearer side, the fragmentation vest lays up as follows:

one ply of Twaron® 840 denier aramid;

petroleum based adhesive layer evenly spread to a 5 mil thickness;

one layer titanium discs in imbricated configuration;

petroleum based adhesive layer evenly spread to a 5 mil thickness;

one ply Twaron® 840 denier aramid;

one ply Kevlar® 1500 denier aramid;

seventeen plys Twaron® 840 denier aramid;

one ply Kevlar® 1500 denier aramid; and seventeen plys Twaron® 840 denier aramid;

This embodiment has a weight per square foot of protected area of approximately 3.57 lbs.

As described above, a rough test of this vest's ability to protect an individual from fragmentation is its response to ballistic tests. The embodiment described immediately above, has been ballisticly tested and been found to have stopping power superior to all analogous products. The vest as described has an ability to completely stop a 7.62×25 mm steel core steel case armor piercing pistol round traveling at 1450 feet per second at impact. Additional armor piercing pistol rounds that can be stopped by this fragmentation vest are: 7.62×25 mm steel case lead core bullet at speeds of at least 1540 feet per second; 9 mm steel core steel case bullet at 1250 to 1300 feet per second; 9 mm 107 grain KTW armor piercing bullet at 1300 feet per second; 7.62×25 mm 85 grain solid steel bullet traveling at 1450 feet per second; 0.357 magnum 107 grain KTW armor piercing bullet with velocities at least 1450 feet per second; and 12 ga. one ounce rifle slug with a 3 inch chambering and a velocity of at least 1500 feet per second. Additional testing of fragmentation response is ongoing. Based on the ballistic results it is expected that the response to fragmentation tests will show similarly superior results.

In the proceeding detailed description, the invention is described with reference to specific embodiments thereof. It will, however, be evident that various modifications and changes may be made thereto without departing from the broader sprit and scope of the invention as set forth in the claims. The specification and drawings are, accordingly, to be regarded in an illustrative rather than a restrictive sense.

What is claimed is:

1. A Fragmentation vest comprising:

a first layer of ballistic grade fabric;

a layer of high hardness plates adhered to the first layer;

a second layer of ballistic grade fabric adhered to the layer of plates;

a third layer of ballistic grade fabric coupled adjacent to and being a different fabric than the second layer;

a fourth layer of ballistic grade fabric being a different fabric than the third layer; and wherein the vest has a weight less than 3.75 pounds per square foot of protected area, with an F6 Stanag 2920 compliance, MIL. STD. 662E fragmentation rating.

2. The fragmentation vest of claim 1 further comprises:

a fifth layer of ballistic grade fabric coupled adjacent to and being a different fabric than the fourth layer; and a sixth layer of ballistic grade fabric coupled adjacent to and being a different fabric than the fifth layer.

3. The fragmentation vest of claim 2 wherein a first fabric is used for each of the first layer, the second layer, the fourth layer and the sixth layer; and a second fabric is used for the third layer and the fifth layer.

4. The fragmentation vest of claim 3 wherein the first fabric has a denier of less than approximately 850 and a pick count less than approximately 40×40.

5. The fragmentation vest of claim 3 wherein the first fabric tends to deform a projectile impacting it.

6. The fragmentation vest of claim 3 wherein the second fabric has a denier of less than approximately 1600 and a pick count less than approximately 40×40.

7. The fragmentation vest of claim 3 wherein the second fabric tends to induce yaw into a projectile impacting it.

8. The fragmentation vest of claim 2 wherein a total ply count of ballistic grade fabric is less than forty.

9. The fragmentation vest of claim 2 wherein the first layer, the second layer, the third layer and the fifth layer each have a ply count less than three; and wherein the fourth layer and the sixth layer each have a ply count less than twenty.

10. The lightweight fragmentation vest of claim 1, wherein the plates comprise a titanium material.

11. The lightweight fragmentation vest of claim 1, wherein the plates comprise a ceramic material.

12. The fragmentation vest of claim 1 wherein, the layer of high tensile strength plates comprises disks in an imbricated pattern.

13. The fragmentation vest of claim 1 wherein the high hardness plates comprises rows of hexagonal plates tiled over the protected area.

14. The fragmentation vest of claim 13 wherein the first layer, the second layer, the third layer and the fifth layer each have a ply count less than three; and wherein the fourth layer and the sixth layer each have a ply count less than twenty-two.

15. The method of claim 14 wherein the fourth layer and the sixth layer each comprises plurality of plys not exceeding twenty-two plys each.

16. The method of claim 14 wherein a total ply count for all ballistic fabric layers is less than forty-five.

17. A fragmentation vest comprising:

a first layer ballistic grade fabric having areal density of less than 0.7 oz./sq. ft.;

a layer of high tensile streng plates adhered to the first layer;

a second layer of ballistic grade fabric adhered to the layer of plates having areal density of less than 0.7 oz./sq.ft.;

a third layer of ballistic grade fabric having an areal density of less than 1.6oz./sq. ft.;

a fourth layer of ballistic grade fabric having an areal density less than 11.50oz./sq. ft.;

a fifth layer of ballistic grade fabric having an areal density of less than 1.6oz./sq. ft.;

a sixth layer of ballistic grade fabric having an areal density less than 11.50 oz./sq. ft.

18. The fragmentation vest of claim 17 wherein a first fabric is used for each of the first layer, the second layer, the fourth layer and the sixth layer; and a second fabric is used for the third layer and the fifth layer.

19. The fragmentation vest of claim 18 wherein the first fabric has a denier of less than approximately 850 and a pick count less than approximately 40×40.

20. The fragmentation vest of claim 18 wherein the first fabric tends to deform a projectile impacting it.

21. The fragmentation vest of claim 18 wherein the second fabric has a denier of less than approximately 1600 and a pick count less than approximately 40×40.

22. The fragmentation vest of claim 18 wherein the second fabric tends to induce yaw into a projectile impacting it.

23. The fragmentation vest of claim 17 wherein a total ply count of ballistic grade fabric is less than forty-five.

24. The method of claim 23 wherein adhering comprises evenly spreading an aggressive adhesive over the first layer and the second layer to a thickness of less than 7 mil.

25. The fragmentation vest of claim 23, wherein the layer of high hardness plates comprises disks in an imbricated pattern.

26. The fragmentation vest of claim 23, wherein the high hardness plates comprise rows of hexagonal plates tiled over the protected area.

27. The fragmentation vest of claim 17, wherein the layer of high hardness plates comprises disks in an imbricated pattern.

28. The fragmentation vest of claim 17, wherein the high hardness plates comprise rows of hexagonal tiled over the protected area.

29. A method of making a flexible lightweight fragmentation vest the method comprising:

providing a first layer of deformation inducing ballistic grade fabric;

adhering a layer of high tensile strength plates to the first layer;

adhering a second layer of deformation inducing ballistic grade fabric to the high tensile strength plates;

coupling a third layer of yaw inducing ballistic grade fabric being a different fabric than the second layer to the second layer; and coupling a fourth layer of deformation inducing ballistic grade fabric being a different fabric than the third layer to the third layer; wherein the vest has a weight less than 3.75 pounds per square foot of protected area.

30. The method of claim 29, further comprising:

coupling to the fourth layer a fifth layer of yaw inducing ballistic grade fabric being a different fabric than the fourth layer; and coupling to the fifth layer a sixth layer of deformation inducing ballistic grade fabric being a different fabric than the fifth layer.

* * * * *